US006679208B2

(12) United States Patent
Stephan et al.

(10) Patent No.: US 6,679,208 B2
(45) Date of Patent: Jan. 20, 2004

(54) DEVICE FOR ADJUSTING THE ANGLE OF ROTATION OF A CAMSHAFT OF AN INTERNAL COMBUSTION ENGINE RELATIVE TO A DRIVE WHEEL

(75) Inventors: Wolfgang Stephan, Boll (DE); Axel-Willi Jochim, Nuertingen (DE); Andreas Knecht, Kusterdingen (DE)

(73) Assignees: Dr. Ing. h.c.F. Porsche Aktiengesellschaft, Stuttgart (DE); Hydraulik Ring GmbH, Limbach-Oberfrohna (DE)

( * ) Notice: Subject to any disclaimer, the term of this patent is extended or adjusted under 35 U.S.C. 154(b) by 0 days.

(21) Appl. No.: 10/221,949

(22) PCT Filed: Nov. 6, 2001

(86) PCT No.: PCT/EP01/12802

§ 371 (c)(1),
(2), (4) Date: Sep. 18, 2002

(87) PCT Pub. No.: WO02/42614

PCT Pub. Date: May 30, 2002

(65) Prior Publication Data

US 2003/0127065 A1 Jul. 10, 2003

(30) Foreign Application Priority Data

Nov. 25, 2000 (DE) ..... 100 58 707

(51) Int. Cl.[7] ..... F01L 1/34

(52) U.S. Cl. ..... 123/90.17; 123/90.15; 123/90.27; 464/2

(58) Field of Search ..... 123/90.1, 90.12, 123/90.15, 90.16, 90.17, 90.27, 90.31; 464/1, 2, 160; 251/12, 14; 277/345, 348, 351, 352, 358

(56) References Cited

U.S. PATENT DOCUMENTS

| | | | | | |
|---|---|---|---|---|---|
| 5,450,825 | A | | 9/1995 | Geyer et al. | 123/90.17 |
| 5,875,750 | A | * | 3/1999 | Iwasaki et al. | 123/90.17 |
| 6,135,077 | A | * | 10/2000 | Moriya et al. | 123/90.17 |
| 6,418,893 | B1 | * | 7/2002 | Auchter et al. | 123/90.15 |

FOREIGN PATENT DOCUMENTS

| | | | |
|---|---|---|---|
| DE | 19745908 | A | 4/1999 |
| DE | 19922194 | A1 | 6/2000 |
| DE | 10020120 | A1 | 10/2001 |

* cited by examiner

*Primary Examiner*—Thomas Denion
*Assistant Examiner*—Ching Chang
(74) *Attorney, Agent, or Firm*—Crowell & Moring LLP

(57) ABSTRACT

An arrangement for relative angle of rotation adjustment of a camshaft of an internal-combustion engine has an interior part non-rotatably connected with the camshaft and having at least approximately radially extending webs or blades. A driven cell wheel has several cells distributed along the circumference and bounded by webs. The cells are divided by the webs or blades into pressure spaces. Sealing bodies are arranged in recesses provided on faces of the webs or blades. For sealing off the pressure spaces by a hydraulic action, the sealing bodies are pressed against an interior wall of the cell wheel. The sealing bodies are constructed as rollers which, provided with an installation play, are received in the recesses. During operation of the adjusting unit, the rollers, for sealing purposes, form line contacts with the interior wall of the cell wheel and with the lateral walls of the recesses.

3 Claims, 2 Drawing Sheets

DEVICE FOR ADJUSTING THE ANGLE OF ROTATION OF A CAMSHAFT OF AN INTERNAL COMBUSTION ENGINE RELATIVE TO A DRIVE WHEEL

BACKGROUND AND SUMMARY OF THE INVENTION

The present invention relates to an arrangement for the relative angle of rotation adjustment of a camshaft of an internal-combustion engine with respect to a driving wheel.

An arrangement of the type mentioned above is known from German Patent Document DE 196 23 818 A1. In a fifth embodiment (see Figures 15 to 18), sealing elements are arranged on faces of rotor blades of a camshaft adjusting device. These sealing elements, which are not indicated in detail, have the purpose of preventing hydraulic oil used for adjusting the rotor with respect to the stator from flowing from the pressure chambers acted upon by hydraulic oil by way of the face of the rotor blades to the adjusting chambers which are momentarily unpressurized.

A vane cell camshaft adjuster is also known from German Patent Document DE 197 45 908 A1. In this case, recesses are provided on faces of the rotor blades, in which recesses roller-shaped rolling bodies are received. These rolling bodies are used for reducing the frictional forces between the driving wheel and the impeller (rotor). The rolling bodies are supported, on one side, directly in the recess and, on the other side, directly at the interior wall of the driving wheel.

In an adjusting unit illustrated in German Patent Document DE 199 22 194 A1, recesses are also provided on the faces of the rotor blades. Rectangular sealing bodies are arranged in these recesses. During operation of the internal-combustion engine, hydraulic oil is delivered into the recesses by way of a leakage gap constructed between the rotor blades and the stator (driving wheel). As a result, the rectangular sealing bodies are pressed, by means of a first lateral surface, against the stator and, by means of a second lateral surface, against the interior flank of the sealing groove (see, for example, Figure 7).

It is an object of the invention to improve an arrangement of this type for the relative angle of rotation adjustment of a camshaft with respect to its driving wheel such that a simple sealing-off of the two pressure spaces of the camshaft adjusting device, which are separated from the rotor blade, takes place in a way which is improved with respect to the prior art.

According to the invention, this object is achieved.

The rollers provided as sealing bodies in the recesses of the rotor blades provide a line contact at the stator (driving wheel) as well as on the interior surface of the sealing groove. This line contact ensures a greater contact pressure force, and thus a more reliable sealing-off of the two pressure spaces separated from the rotor blades, in comparison to a surface contact (see DE 199 22 194 A1). Furthermore, because of the two line contacts of the rollers used, the friction is significantly less in contrast to the rectangular sealing elements.

An embodiment of the invention will be explained in detail in the following description and is shown in the drawings.

DETAILED DESCRIPTION OF THE INVENTION

Figure 2:
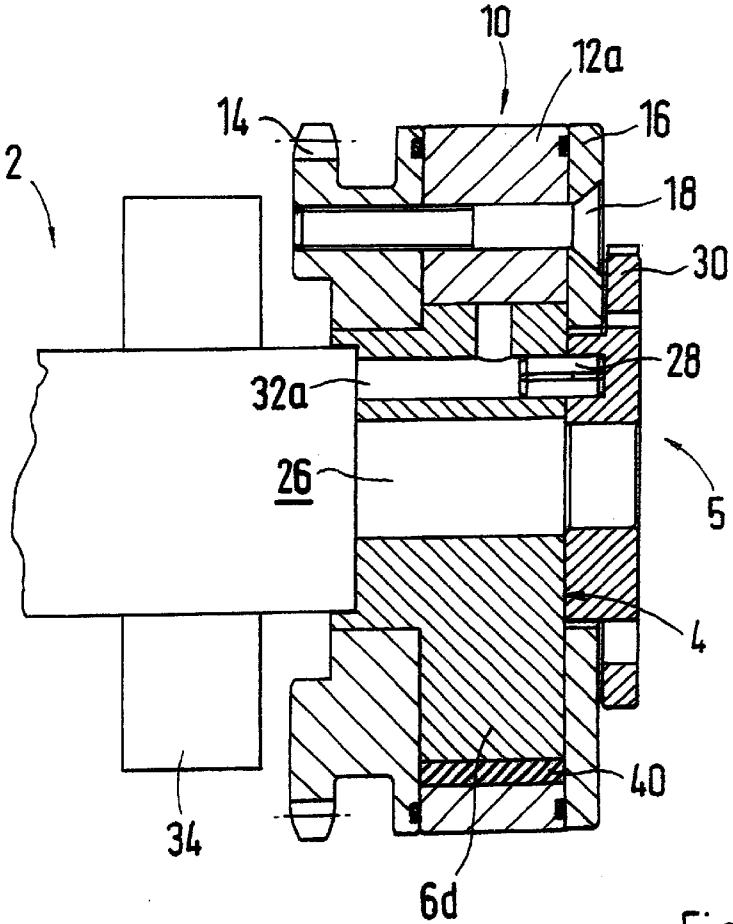
FIG. 2 is a sectional view along line II—II in FIG. 1.
Figure 1:
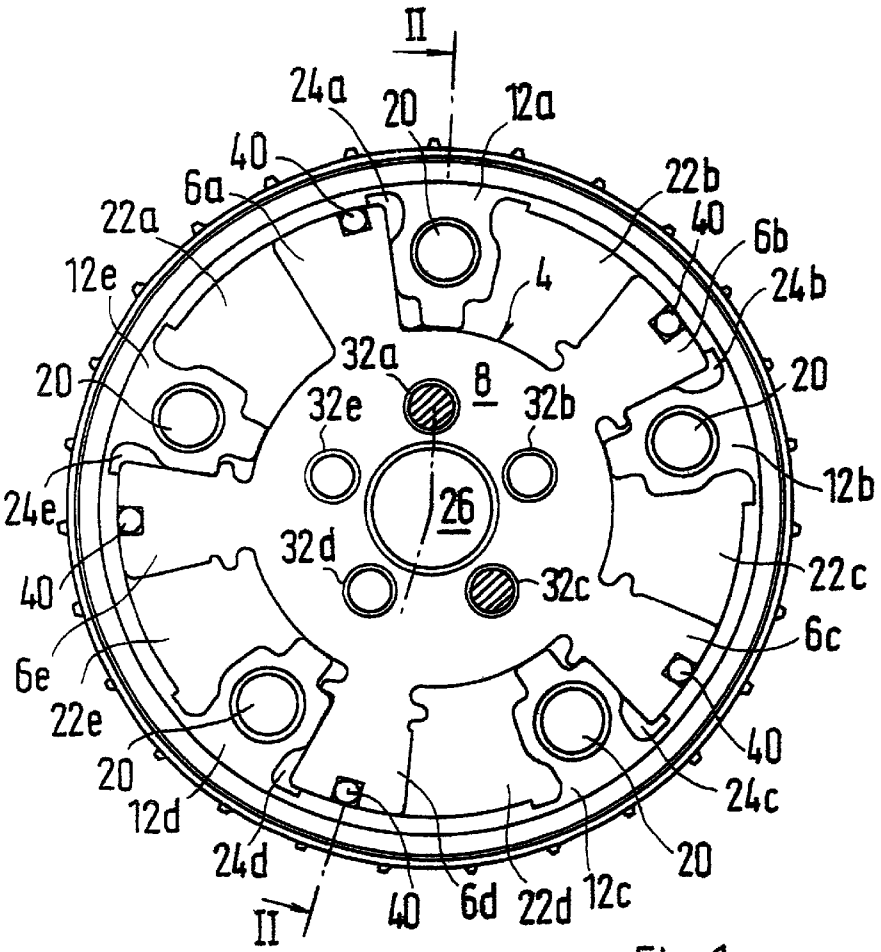
FIG. 1 is a sectional view of a camshaft adjusting device.
Figure 3:
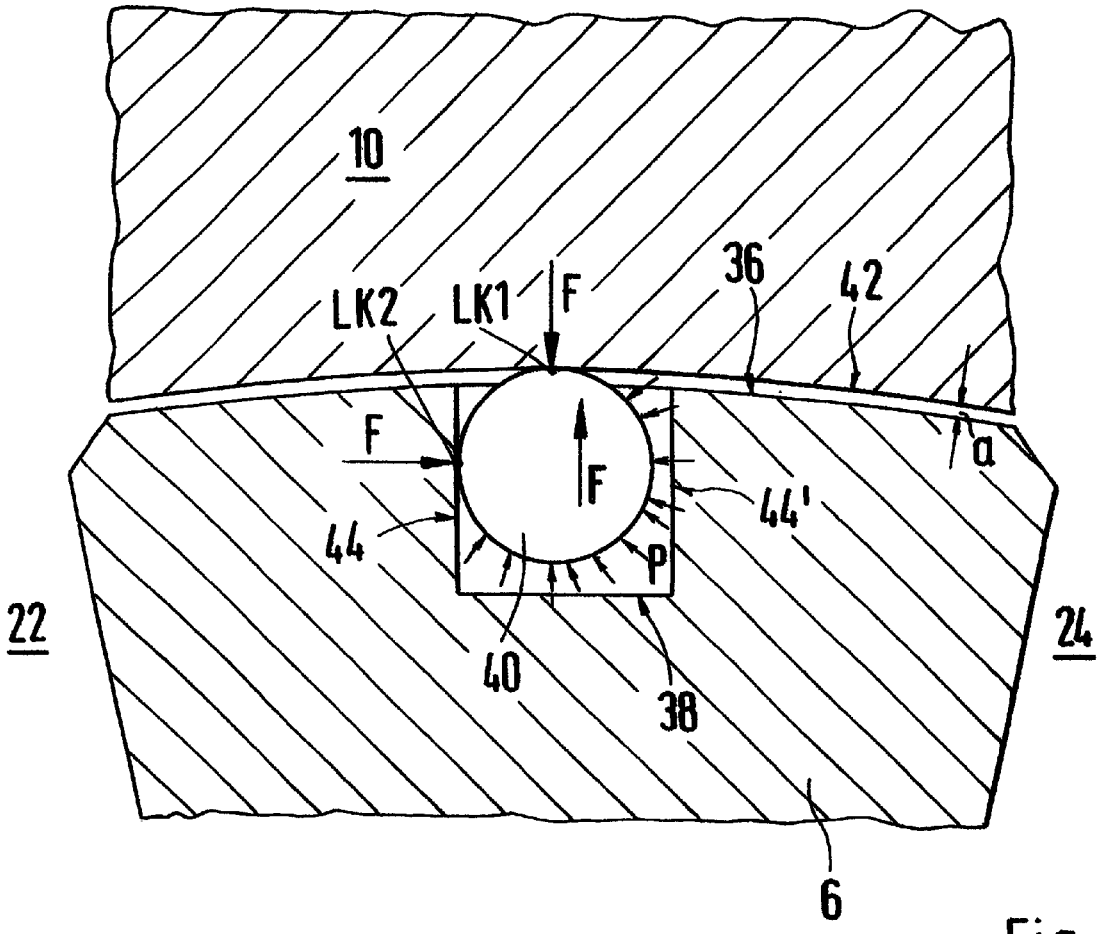
FIG. 3 is an enlarged cutout of a rotor blade.

In the drawings, reference number 2 schematically outlines the camshaft of an internal-combustion engine, at whose free end an interior part of an adjusting unit 5 is arranged, which interior part will be called a rotor 4 in the following. In this embodiment, the rotor 4 is provided with five radially arranged blades 6*a* to 6*e* which originate from a hub 8 of the rotor 4. In the area of its blades 6*a* to 6*e*, a cell wheel 10 reaches around the rotor 4 and is provided with five radial webs 12*a* to 12*e* projecting into the interior. The cell wheel 10 forming the stator of the adjusting unit 5 is closed off by a chain wheel 14 on its face facing the camshaft 2, which chain wheel 14 is rotatably and sealingly guided on the hub 8 of the rotor 4. The chain wheel 14 is used as a drive for the camshaft 2 which takes place, for example, by way of a drive chain connected with the crankshaft. The opposite face of the cell wheel 10 is closed by a disk 16, the chain wheel 14 and the disk 16 being fixedly connected with the cell wheel 10 by way of fastening screws 18. The passage openings 20 provided in the webs 12*a* to 12*e* in the cell wheel 10 are used for receiving or guiding these fastening screws 18. The webs 12*a* to 12*e* of the cell wheel 10 form five cells which are bounded in the axial direction by the chain wheel 14 and the disk 16, which cells are divided by the blades 6*a* to 6*e* of the rotor 4 into two pressure spaces 22*a* to 22*e* and 24*a* to 24*e* respectively. The rotor 4 and the cell wheel 10 rotatably guided on the latter are fastened to the camshaft 2 by means of a cap screw (not shown). For receiving the cap screw, the hub 10 has a central bore 26.

By means of two dowel pins 28 and the cap screw, a signal generator disk 30 is fastened to the exterior side of the rotor 4. By means of the signal generator disk 30 the rotating position of the camshaft 2 with respect to the crankshaft can be detected. The five axial bores 32*a* to 32*e* arranged in the hub 8 of the rotor 4 represent some of the oil supply ducts for the pressure spaces 24*a* to 24*e*. The pressure spaces 22*a* to 22*e* are also supplied with hydraulic oil by way of radially extending bores (not shown) which are arranged in the hub. The hydraulic oil supply for the two pressure spaces 22*a* to 22*e* and 24*a* to 24*e* respectively takes place by way of a camshaft bearing 34, to which corresponding control lines for the oil pressure supply of the adjusting unit 5 are connected. The manner of the oil feeding to the pressure spaces 22*a* to 22*e* and 24*a* to 24*e* respectively is known, for example, from German Patent Document DE 199 30 711 C1, so that the more precise construction of the oil feeding ducts to the pressure spaces does not have to be discussed in detail.

On the free face 36 of each blade 6*a* to 6*e*, groove-shaped recesses 38 are provided. A sealing body 40 constructed as a metallic roller is received in each groove-shaped recess. In the present embodiment, the rollers 40 have a diameter of 3 mm (−0.006/−0.002), and the groove-shaped recesses 38 have a clearance fit of 3 mm H7 (0/+0.01). A gap "a" is constructed between the free face 36 of the blades 6*a* to 6*e* and the interior wall 42 of the cell wheel 10. This gap "a" has a tolerance in the range of from 0.01 to 0.1. When oil pressure feeding takes place to the pressure spaces 24*a* to 24*e* for adjusting the rotor 4 with respect to the cell wheel 10, the rotor 4 is adjusted counterclockwise in the desired manner. Because the gap "a" is formed between the free faces 36 of the blades 6*a* to 6*e* and the interior wall 42 of the cell wheel 10, a leakage oil quantity arrives by way of the gap "a" in the groove-shaped recesses 38. Since the rollers 40 are received in the grooves 38 with a clearance fit, as a result of the hydraulic oil flowing into the grooves 38, the sealing bodies 40 are pressed against the interior wall 42 of the cell wheel 10. As a result of the line contact LK1 between the rollers 40 and the interior wall 42 and the line contact LK2 between the rollers 40 and the lateral walls 44 of the groove-shaped recesses 38, it is ensured that the hydraulic oil situated in the pressure chambers 24*a* to 24*e* will not arrive in the pressure chambers 22*a* to 22*e* by way of the gap "a", the latter being pressureless at this point in time.

When an adjustment of the rotor 4 with respect to the cell wheel 10 or the chain wheel 14 is to take place in the opposite direction, that is clockwise, pressure oil is admitted to the pressure spaces 22*a* to 22*e*. In this case, the sealing-off of the faces 36 with respect to the interior wall 42 of the cell wheel 10 takes place analogously: the sealing bodies 40 form a line contact LK1' with the interior wall 42 and a line contact LK2' with the lateral walls 44' of the groove-shaped recesses 38, so that it is also ensured here during the adjusting operation that the hydraulic oil situated in the pressure chambers 22*a* to 22*e* cannot arrive in the pressure chambers 24*a* to 24 by way of the gap "a".

What is claimed is:

1. An arrangement for relative angle of rotation adjustment of a camshaft of an internal-combustion engine with respect to a driving wheel, comprising:

an interior part which is non-rotatably connected with the camshaft and which has at least approximately radially extending blades, a driven cell wheel which has several cells distributed along its circumference and bounded by webs, each of said cells being divided by at least one of the webs or blades of the interior part, guided within the cells in an angularly movable manner, into two pressure spaces, the camshaft being rotatable by way of the webs or blades between two end positions relative to the cell wheel when hydraulic pressure is admitted to or removed from the two pressure spaces by way of control lines, and sealing bodies arranged on free faces of the blades for sealing off the pressure spaces bounded by the webs or blades, wherein recesses are provided on the faces of the webs or blades in which the sealing bodies are arranged, said sealing bodies, for sealing off the pressure spaces by a hydraulic action, being pressed against an interior wall of the cell wheel, and wherein the sealing bodies are constructed as rollers which, provided with an installation play, are received in the recesses, the rollers, during operation of the adjusting unit, for the purpose of sealing, forming line contacts with the interior wall of the cell wheel and line contacts with the lateral walls of the recesses.

2. The arrangement as defined in claim 1, wherein said rollers are metallic.

3. The arrangement as defined in claim 1, wherein said rollers seal off a gap between said free faces of the blades and said interior wall of the cell wheel.

* * * * *